US010385845B2

(12) United States Patent
Garland et al.

(10) Patent No.: US 10,385,845 B2
(45) Date of Patent: Aug. 20, 2019

(54) HIGH PRESSURE FUEL PUMP

(71) Applicant: DELPHI TECHNOLOGIES IP LIMITED, St. Michael (BB)

(72) Inventors: Paul F. Garland, Gillingham (GB); Toby J. Pedley, London (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 321 days.

(21) Appl. No.: 15/111,511

(22) PCT Filed: Dec. 3, 2014

(86) PCT No.: PCT/EP2014/076373

§ 371 (c)(1),
(2) Date: Jul. 14, 2016

(87) PCT Pub. No.: WO2015/106877

PCT Pub. Date: Jul. 23, 2015

(65) Prior Publication Data

US 2016/0341194 A1 Nov. 24, 2016

(30) Foreign Application Priority Data

Jan. 15, 2014 (GB) ..... 1400656.3

(51) Int. Cl.
*F04B 9/04* (2006.01)
*F02M 59/10* (2006.01)
(Continued)

(52) U.S. Cl.
CPC ..... *F04B 53/14* (2013.01); *F02M 59/102* (2013.01); *F02M 59/442* (2013.01); *F04B 9/042* (2013.01);
(Continued)

(58) Field of Classification Search
CPC .. F04B 9/04; F04B 9/042; F04B 19/22; F04B 53/008; F04B 53/04; F04B 53/10;
(Continued)

(56) References Cited

U.S. PATENT DOCUMENTS

2003/0161746 A1* 8/2003 Asayama ..... F02M 39/00 417/470
2004/0052652 A1* 3/2004 Yamada ..... F02M 59/102 417/273

(Continued)

FOREIGN PATENT DOCUMENTS

DE 102008002195 A1 12/2009
EP 2620633 A1 7/2013
JP 2005069146 A1 3/2005

*Primary Examiner* — Philip E Simpert
(74) *Attorney, Agent, or Firm* — Joshua M. Haines

(57) ABSTRACT

A high pressure fuel pump includes a pump head from which extends a turret, a bore extends along a main axis from a pumping chamber through the turret to an open end. A piston is arranged in the bore and protrudes out of the turret, an outer extremity being provided with a cam follower. A spring is arranged around the piston and slipped over the turret, the spring is compressed between the cam follower and the main part of the pump head. A cup shaped sleeve is arranged around the turret and defines a volume between the turret and the peripheral wall which fills with fuel that has leaked between the piston and the blind bore from the pumping chamber. A bottom face of the sleeve is provided with a hole through which the piston extends. An opening in the peripheral wall allows fuel to exit the volume.

7 Claims, 1 Drawing Sheet

(51) Int. Cl.

| | |
|---|---|
| ***F02M 59/44*** | (2006.01) |
| ***F04B 19/22*** | (2006.01) |
| ***F04B 53/00*** | (2006.01) |
| ***F04B 53/04*** | (2006.01) |
| ***F04B 53/10*** | (2006.01) |
| ***F04B 53/14*** | (2006.01) |
| ***F04B 53/16*** | (2006.01) |

(52) U.S. Cl.
CPC ..... *F04B 19/22* (2013.01); *F04B 53/008* (2013.01); *F04B 53/04* (2013.01); *F04B 53/10* (2013.01); *F04B 53/16* (2013.01)

(58) Field of Classification Search
CPC ..... F04B 53/14; F04B 53/16; F04B 15/04; F04B 15/06; F04B 1/0404; F04B 1/0408; F04B 1/0452; F04B 1/0443; F04B 13/00; F04B 17/05; F04B 9/02; F04D 29/08; F02D 2250/31; F02D 41/3836; F02D 41/3845; Y10T 137/85978; F02C 9/30
USPC ..... 417/471, 423.11, 423.14
See application file for complete search history.

(56) References Cited

U.S. PATENT DOCUMENTS

| | | | | |
|---|---|---|---|---|
| 2005/0019188 | A1* | 1/2005 | Usui | F02M 55/04 417/540 |
| 2006/0228239 | A1* | 10/2006 | Usui | F02M 59/102 417/470 |
| 2008/0213112 | A1* | 9/2008 | Lucas | F02M 59/02 417/471 |
| 2009/0159053 | A1* | 6/2009 | Stockner | F02M 59/44 123/495 |
| 2015/0017035 | A1* | 1/2015 | McCrindle | F02M 59/102 417/434 |

* cited by examiner

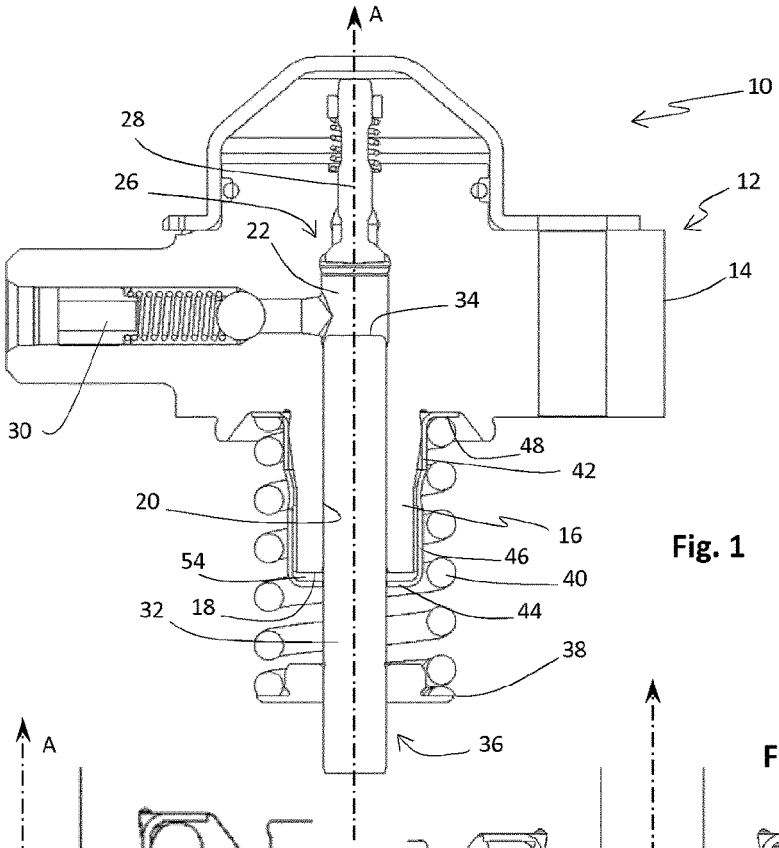
Fig. 1
Fig. 2
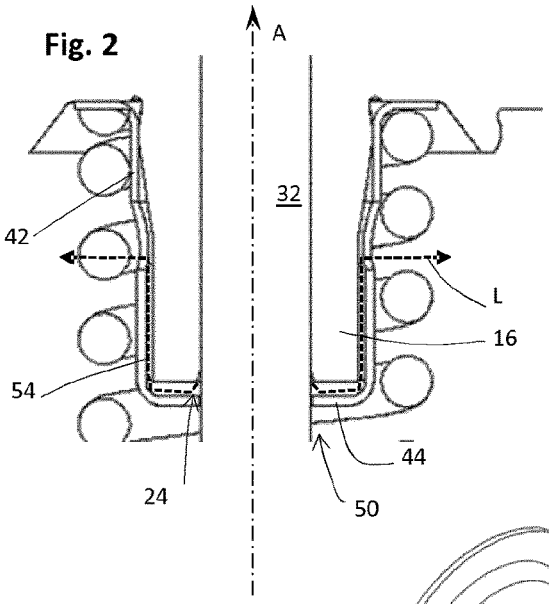
Fig. 3
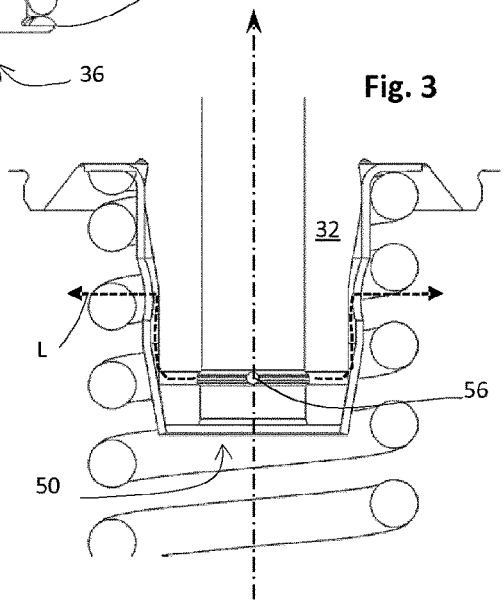
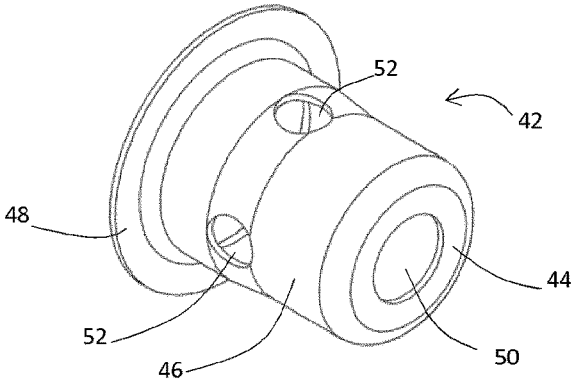
Fig. 4

HIGH PRESSURE FUEL PUMP

CROSS REFERENCE TO RELATED APPLICATIONS

This application is a national stage application under 35 USC 371 of PCT Application No. PCT/EP2014/076373 having an international filing date of Dec. 3, 2014, which is designated in the United States and which claimed the benefit of GB Patent Application No. 1400656.3 filed on Jan. 15, 2014 the entire disclosures of each are hereby incorporated by reference in their entirety.

TECHNICAL FIELD

The present invention relates to a high pressure fuel pump and more particularly to a mean enabling avoiding thermal seizure of the pump.

BACKGROUND OF THE INVENTION

A high pressure fuel pump typically has a head with a turret from which axially protrudes a piston reciprocally moving inside a bore of the head. The fuel pressurized is hot and some of it leaks along the piston and exits at the extremity of the turret. Fluid shear losses heat the fuel further in the clearance between the piston and bore, so the exit temperature is extremely high. An important thermal gradient exists across the turret and consequently the piston thermal expansion exceeds the turret thermal expansion diminishing the clearance and potentially damaging the pump. To avoid such problem the bore-piston clearance is typically sized to accommodate this difference however this enables more fuel leakage and therefore lower pump efficiency.

SUMMARY OF THE INVENTION

Accordingly, it is an object of the present invention to resolve the mentioned problems by providing a high pressure fuel pump comprising a pump head, a piston and a spring.

The pump head has a main part and a cylindrical turret protruding along a main axis from the main part to a distant disc face, a blind bore extending along the main axis from a pumping chamber, inside the pump head then through the turret until an open end in the disc face. It further has a low pressure inlet and a high pressure outlet opening in the pumping chamber and which are adapted to flow fuel in and out of the bore.

The piston is arranged slidably guided in the bore, it extends from a compression extremity in the pumping chamber of the bore to an outer extremity outside the pump head, the outer extremity being provided with a cam follower.

The spring is arranged around the piston and slipped over the turret; it is compressed between the cam follower and the main part of the pump head.

The pump is further provided with a sleeve having a cup shape with a bottom face and a peripheral wall. The sleeve is arranged around the turret reserving a thin volume between the turret and the peripheral wall. The bottom face of the sleeve is provided with a hole through which extends the piston so that, in operation, part of the fuel pressurized between the compression extremity of the piston and the pumping chamber of the bore leaks between the piston and the bore, gets out of the turret and fills said thin volume prior to exiting the sleeve.

Furthermore, the sleeve may be provided with at least one opening arranged in the peripheral wall, the opening being adapted to enable fuel to exit the thin volume.

The sleeve may have a disc face radially extending from the edge of the peripheral wall that is distant from the bottom face. The radial disc face is arranged in abutment against the pump head and the spring is slipped over the sleeve compressed against said radial disc face of the sleeve.

In another embodiment, the turret is provided with a radial hole arranged in the vicinity of its extremity disc face so that the leaking fuel is captured and flows through this radial hole prior to going into the sleeve.

BRIEF DESCRIPTION OF THE DRAWINGS

The present invention is now described by way of example with reference to the accompanying drawings in which:

FIG. 1 is an axial section of a high pressure pump as per the invention.

FIG. 2 is a detail of the pump of FIG. 1.

FIG. 3 is a similar detail as FIG. 2 but of another embodiment of the invention.

FIG. 4 is an isometric representation of a sleeve that is arranged on the pump of FIG. 1.

DESCRIPTION OF THE PREFERRED EMBODIMENTS

In the following description, similar elements will be designated with the same reference numbers. Also, to ease and clarify the description a top-down orientation will be followed in reference to the orientation of the figures. Therefore, words and expressions such as top, upper, lower, over, under, etc. may be utilized without any intention to limit the scope of the invention.

The invention is now described in reference to FIGS. 1-4. FIG. 1 is a cross section of a high pressure fuel pump 10 comprising a pump head 12 having a main part 14, and from a lower face of said main part 14 the pump head 12 is provided with a protruding turret 16 downwardly extending along a main axis A from the main part 14 until a disc face 18. The pump head 12 is further provided with a bore 20 downwardly extending along a main axis A from a pumping chamber 22, inside the pump head 12 to a downward opening 24 centrally arranged in the disc face 18 of the turret 16.

The pump head 12 is further provided with a fuel inlet 26 arranged at the very top of the bore 20. A poppet valve 28 controls the opening and closing of fuel inlet 26. A fuel outlet 30, which opening and closing are controlled by a ball pressed against a seat, is arranged laterally in the pump head 12 and opens in the pumping chamber 22. Multiple variants of inlet valves and outlets exist in the art, and the description made does not limit the invention to this specific embodiment.

In the bore 20 is slidably arranged a piston 32 that extends from an inner end 34, or top end, inside the bore 20, to an outer end 36, or bottom end, outside the pump head 12. At the outer end 36 is arranged a spring seat 38 that holds a spring 40 compressed between spring seat 38 and the main part 14 of the pump head 12. The spring 40 is arranged around the piston 32 and is slipped around the turret 16. At the very bottom end of the piston is arranged a non-represented cam follower, that in operation cooperates with a rotating cam.

As seen on the figures, a sleeve 42 is arranged around the turret 16. The sleeve 42 is blanked and deep drawn from a thin metal sheet and has a cup shape with a transversal bottom face 44 from which extends a substantially cylindrical peripheral wall 46 and an upper disc face 48 that radially extends from the upper edge of the peripheral wall 46. The sleeve 42 is further provided with a hole 50 centrally arranged in the bottom face 44 in order to enable the piston 32 to extend through, and with at least one opening 52 in the peripheral wall 46. On the figures, the openings 52 are represented at about mid distance between the bottom face 44 and the upper disc face 48 but they could be closer to either one of the transversal faces.

When in place, the sleeve 42 is maintained in place as the spring 40 is slipped around the sleeve 42 and it abuts against the under face of the upper disc face 48. A thin volume 54 surrounding the turret 16 remains between the turret 16 and the sleeve 42.

In operation the non-represented cam actuates the cam follower and the piston 32 in a reciprocal up-and-down movement. The fuel that has flowed in the pumping chamber 22 is pressurized before being expelled though the outlet 30. During this operation fuel in the pumping chamber 22 heats up and all parts thermally expand. A small quantity of the pressurized fuel leaks, as indicated by the reference L, through the clearance between the bore 20 and the piston 32 lubricating the surfaces. Further substantial heating of the leaking fuel occurs due to fluid shear in the clearance. The leaking fuel finally exits said clearance at the bottom of the turret 16 and instead of continuing to flow downwardly, the leaked fuel is captured inside the sleeve 42 where it fills the thin volume 54, wetting with hot fuel the outer surface of the turret 16. The fuel flows up in the sleeve until it exits via the openings 52. Thanks to this, the temperature gradient across the turret 16 is minimized and so is the risk of gripping of the piston 32 within the bore 20 due to differential thermal expansions.

In another embodiment detailed in FIG. 3, the turret 16 is provided with radial holes 56 arranged close to the disc face 18 of the turret. In this embodiment the fuel leaks via these radial holes 56 then fill the thin volume 54.

In the above description the following references have been utilized:

10 pump
12 pump head
14 main part of the pump head
16 turret
18 disc face
20 bore
22 pumping chamber
24 opening of the bore
26 fuel inlet
28 poppet valve
30 fuel outlet
32 piston
34 inner end of the piston
36 outer end of the piston
38 spring seat
40 spring
42 sleeve
44 bottom face
46 peripheral wall
48 upper disc face
50 hole in the sleeve
52 opening in the sleeve
54 thin volume
56 radial holes
A main axis
L fuel leak path

The invention claimed is:

1. A high pressure fuel pump comprising:

a pump head having a main part and a cylindrical turret protruding along a main axis from the main part to a distant disc face, a blind bore extending along the main axis from a pumping chamber, inside the pump head then through the cylindrical turret to an open end in the distant disc face and a low pressure inlet and a high pressure outlet opening in the pumping chamber which flow fuel in and out of the blind bore respectively, a piston arranged to be slidably guided in the blind bore, the piston extending from a compression extremity in the pumping chamber of the blind bore to an outer extremity outside the pump head, the outer extremity being provided with a cam follower, a spring arranged around the piston and slipped over the cylindrical turret such that the spring circumferentially surrounds the cylindrical turret, the spring being compressed between the cam follower and the main part of the pump head, and a sleeve having a cup shape with a bottom face and a peripheral wall, the sleeve being arranged around the cylindrical turret defining a volume between the cylindrical turret and the peripheral wall which fills with fuel that has leaked between the piston and the blind bore from the pumping chamber, the bottom face of the sleeve being provided with a hole through which the piston extends and the sleeve also being provided with an opening in the peripheral wall which allows fuel to exit the volume, wherein the sleeve is further provided with a radial disc face radially extending from an edge of the peripheral wall that is distant from the bottom face, the radial disc face being in abutment against the pump head, the opening in the peripheral wall being located between the bottom face and the radial disc face, and the spring surrounding the sleeve and being compressed against the radial disc face of the sleeve.

2. A high pressure fuel pump as set forth in claim 1 wherein the cylindrical turret is provided with a radial hole which extends radially through the cylindrical turret and which allows fuel that has leaked between the piston and the blind bore from the pumping chamber to pass to the thin volume.

3. A high pressure fuel pump as set forth in claim 1 wherein, relative to the main axis, the peripheral wall is radially between the turret and the spring.

4. A high pressure fuel pump as set forth in claim 1 wherein, relative to the main axis, the opening in the peripheral wall is radially aligned with the spring.

5. A high pressure fuel pump as set forth in claim 1 wherein the turret is of unitary construction with the main part.

6. A high pressure fuel pump as set forth in claim 1 wherein the radial disc face is in abutment against the main part of the pump head in a direction parallel to the main axis.

7. A high pressure fuel pump as set forth in claim 1 wherein one side of the radial disc face engages the main part of the pump head in a direction parallel to the main axis and another side of the radial disc face, which is opposite said one side of the radial disc face, engages the spring.

* * * * *